United States Patent [19]

Ushijima et al.

[11] 4,208,361

[45] Jun. 17, 1980

[54] AUTOMOBILE WITH ALTITUDE COMPENSATED FUEL FEED MEANS

[75] Inventors: Takashi Ushijima, Tokyo; Yoshio Iwasa, Nagareyama; Tomofusa Horiuchi, Yokohama, all of Japan

[73] Assignee: Nissan Motor Company, Limited, Yokohama, Japan

[21] Appl. No.: 786,429

[22] Filed: Apr. 11, 1977

[30] Foreign Application Priority Data

Apr. 15, 1976 [JP] Japan ..... 51/43270
Jul. 22, 1976 [JP] Japan ..... 51/87570

[51] Int. Cl.[2] ..... F02M 7/24

[52] U.S. Cl. ..... 261/121 B; 137/625.48; 137/625.5; 251/61.5; 251/75

[58] Field of Search ..... 261/121 B, 39 A; 137/625.5, 625.48; 251/75, 61.5

[56] References Cited

U.S. PATENT DOCUMENTS

| | | | |
|---|---|---|---|
| 1,729,382 | 9/1929 | Harel | 261/121 B |
| 2,208,317 | 7/1940 | Beck | 261/121 B |
| 2,560,090 | 7/1951 | Crow | 251/75 |
| 2,966,928 | 1/1961 | Fairchild | 251/251 |
| 3,313,532 | 4/1967 | Carlson et al. | 261/41 D |
| 3,353,559 | 11/1967 | Phillips | 251/75 |
| 3,374,991 | 3/1968 | Walker | 261/DIG. 19 |
| 3,502,297 | 3/1970 | Wardrup | 251/25 |
| 3,532,121 | 1/1970 | Sturman | 251/75 |
| 3,795,237 | 3/1974 | Denton | 261/121 B |
| 3,859,397 | 1/1975 | Tryon | 261/39 A |
| 3,861,366 | 1/1975 | Masaki et al. | 261/121 B |
| 3,960,990 | 6/1976 | Bishop et al. | 261/121 B |
| 4,097,563 | 6/1978 | Yuzawa | 261/121 B |

FOREIGN PATENT DOCUMENTS

| | | | |
|---|---|---|---|
| 1380472 | 1/1975 | United Kingdom | 261/39 A |

*Primary Examiner*—Tim R. Miles

[57] ABSTRACT

An automobile is provided with an altitude compensated fuel feed means which comprises a fuel feed circuit with an air bleed orifice, an independent additional air supply passage leading to the fuel feed circuit, an air bleed control valve for opening the additional air supply passage, and a control unit with a manually operable part. The manually operable part is disposed in a passenger compartment. Operative interconnection between the control unit and the air bleed control valve is such that manually operating the manually operable part will cause the air bleed control valve to be opened to permit the entry of additional air into the fuel feed circuit, thereby making altitude compensation of the fuel feed means easy.

5 Claims, 20 Drawing Figures

AUTOMOBILE WITH ALTITUDE COMPENSATED FUEL FEED MEANS

BACKGROUND OF THE INVENTION

The present invention relates to automobiles with an altitude compensated fuel feed means, such as an altitude compensated carburetor.

An automobile having an internal combustion engine with an altitude compensated fuel feed means is known. With the altitude compensated fuel feed means air fuel mixture will be prevented from becoming excessively rich when the automobile is operating at high altitudes.

If a fuel feed means is set to provide an optimum air fuel ratio at low altitudes, the air fuel ratio will become considerably richer as altitude increases because air density decreases.

Various kinds of altitude compensation systems employing an aneroid bellows have been proposed and put into practice in order to solve the above described problem. Among them, it is well known to provide a carburetor with an independent additional air supply passage and with an aneroid bellows actuated valve. The valve will increase the flow sectional area of the additional air supply passage as altitude increases to prevent enrichment of the mixture fed to an engine from the carburetor. The problem encountered in the altitude compensation system employing an aneroid bellows resides in the use of such aneroid bellows. It has often been experienced that the aneroid bellows is damaged due to the vehicle vibration. Moreover the bellows is expensive and thus has a cost disadvantage. It has also been experienced that the vehicle vibration is apt to wear a valve at a fast rate so that precise control of the amount of air entering into the carburetor cannot be expected after a long use.

SUMMARY OF THE INVENTION

It is therefore an object of the present invention to provide an altitude compensation system for a fuel feed means of an automobile, which has a long life and is economical.

Based on the recognition that, different from the airplanes, altitude change upon operation of an automobile is not rapid and the automobile is apt to be operated at substantially the same altitude for relatively a long time, it is proposed, according to the invention, to use a manually operable control unit and an on-off air bleed control valve actuated by the manually operable control unit, thereby eliminating the use of an aneroid bellows and a metering valve actuated by the aneroid bellows. In a system according to the invention a manually operable part of the control unit is disposed in the vehicle passenger compartment so that from the passenger compartment the air bleed control valve will be opened to shift the fuel feed means to a condition suitable for engine operation at high altitudes.

BRIEF DESCRIPTION OF THE DRAWINGS

The present invention will be described hereinafter with reference to the accompanying drawings, in which.

PRECISE DESCRIPTION OF THE PREFERRED EMBODIMENTS

Figure 1:
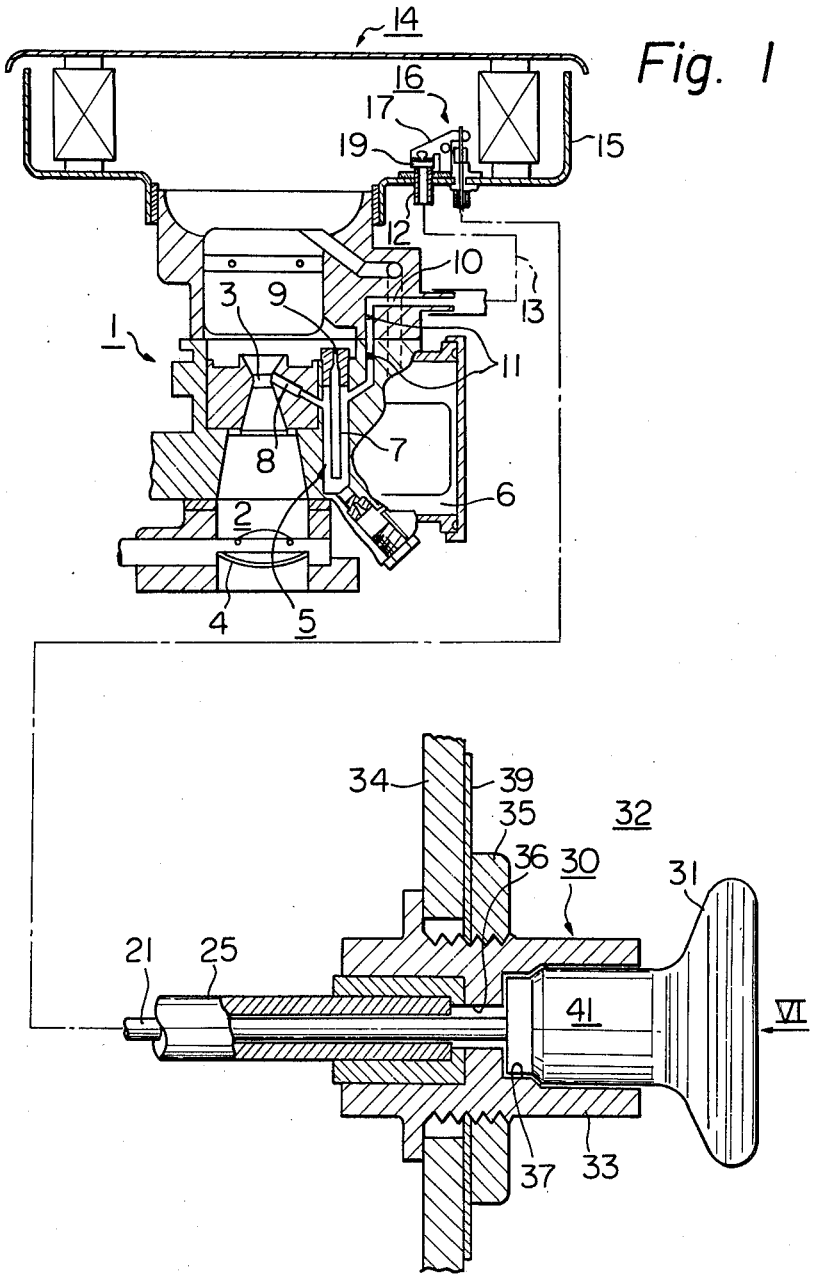
FIG. 1 shows a first embodiment of the present invention.

Referring to the accompanying drawings, FIGS. 1–7 show a first preferred embodiment employing, as a fuel feeding means, a carburetor 1 as shown in FIG. 1.

The carburetor 1 has an air induction passage 2, a boost venturi 3, and a throttle valve 4 mounted within the induction passage 2 downstream of the boost venturi 3. A fuel feed circuit 5, which communicates a fuel float 6 with the boost venturi 3, comprises a fuel well 7 and a fuel nozzle 8 connecting the fuel well to the boost venturi 3. An air bleed orifice 9 is open to the fuel well 7. An independent air bleed passage 10 is open to the fuel well 7 for the purpose of permitting additional air to be bled into the fuel well 7, when altitude is high, to prevent an enrichment of the carburetor. The air bleed passage 10 is provided with two flow restricting orifices 11 therein.

The air bleed passage 10 is connected to a short pipe 12 with a rubber tube 13, diagrammatically shown in FIG. 1. The short pipe 12 has one end projected into an air cleaner 14 through a casing 15 of the cleaner. Mounted within the air cleaner is an air bleed control valve 16 which opens or closes the short tube 12.

Figure 2:
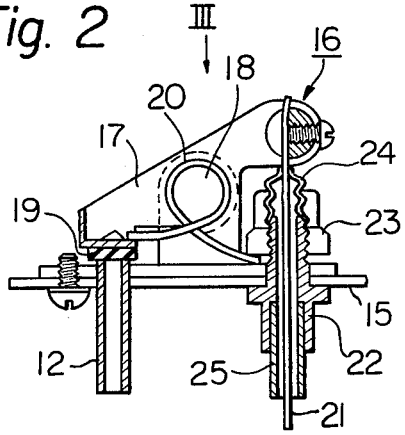
FIG. 2 is an enlarged fragmentary view of FIG. 1.
Figure 3:
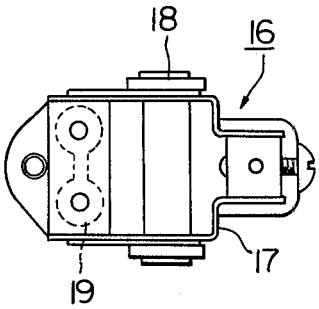
FIG. 3 is a top plan view as viewed along an arrow III in FIG. 2.

The control valve 16, as best seen in FIG. 2 comprises a lever 17, rotatably mounted on a pivot shaft 18, carries at its one arm a valve 19 adapted to close the short pipe 12. Wound around the shaft 18 is a spring 20 to bias the lever 17 anticlockwise (viewing in FIG. 2) toward a valve closed position in which the valve 19 engages the end of the short pipe 12 to close it, as illustrated in FIG. 2. Linked to the other arm of the lever 17 is a cable 21. The cable 21 has one end fixed to the lever 17 and extends outwardly of the air cleaner 14 through a nipple 22 securely mounted to the casing 15 with a nut 23. Denoted by 24 is a boot cover to prevent dust entering into the air cleaner 14 via the nipple 22. The cable 21, covered by a tube 25, leads to a control unit 30 and fixedly connected with a manually operable knob 31 of the control unit, disposed within a vehicle passenger compartment 32, as shown in FIG. 1.

Preferably, the valve 19 (see FIG. 2) is made of a rubber like material because it has a superior sealing effect.

Referring now to FIGS. 1 and 4–7, the control unit 30 has a member 33 which holds the manually operable knob 31. The member 33 extends through and securely attached to an instrument panel 34 with a nut 35. The member 33 is formed with a hole 36 permitting the cable 21 to extend to the manually operable knob 31.

Figure 4:
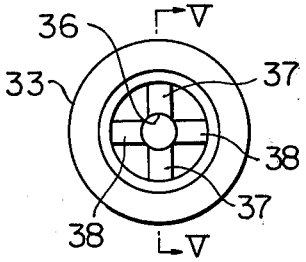
FIG. 4 is a plan view of a component part of a device shown in FIG. 1.
Figure 5:
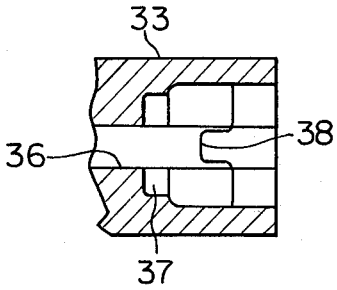
FIG. 5 is a sectional view taken through line V—V in FIG. 4.

As best seen in FIGS. 4 and 5, the member 33 is formed with a deep straight groove 37 and a shallow straight groove 38 which crosses the deep straight groove 37 at right angles. A face plate 39 is attached to the instrument panel 34 with the nut 35, and has formed thereon markings "LOW" and "HIGH", while the knob 31 has formed thereon an index 40 (see FIG. 6). The knob 31 has a tooth-like projection 41 engageable in one of the grooves 37 and 38.

Figure 6:
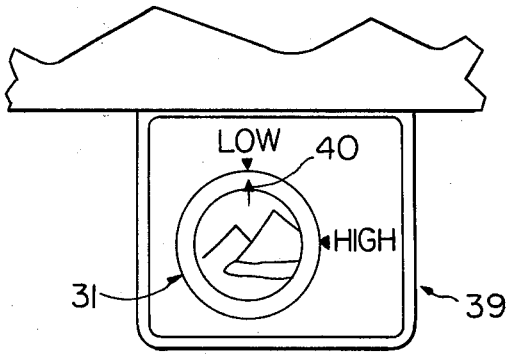
FIG. 6 is a plan view as viewed along an arrow VI in FIG. 1.

The operation of the device shown in FIGS. 1–7 is the following:

For operation of the automobile at low altitude, the knob 31 is positioned in a "LOW" condition as illustrated in FIGS. 1 and 6. In this condition, the tooth-like projection 41 engages in the deep straight groove 37 so that the cable 21 is relaxed to allow the lever 17 (see also FIG. 2) to urge the valve 19 toward the illustrated position in which the valve 19 closes the pipe 12. Therefore, the air bleed passage 10 is inoperative in which no air is bled into the fuel well 7 via the air bleed passage 10, and the air bleed orifice 9 determines volume of air bled into the fuel well 7.

Figure 7:
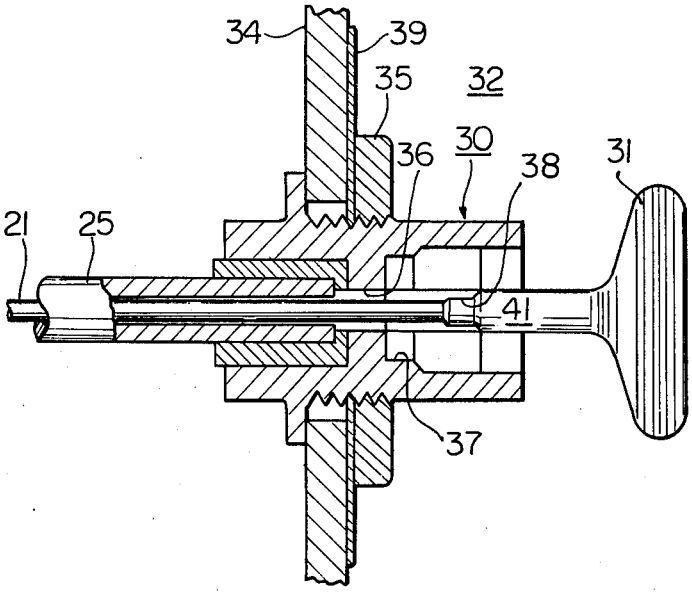
FIG. 7 is a fragmentary view showing a different condition of the device shown in FIG. 1.

For operation of the automobile at high altitudes, such as in Mexico City with 2,300 m altitude above sea level, the knob 31 is moved rightwardly (viewing in FIG. 1) and subsequently rotated, through 90 degrees, to a "HIGH" condition (see FIG. 6) as shown in FIG. 7, in which the tooth-like projection 41 engages in the shallow straight groove 38. This rightward movement of the knob 31 pulls the cable 21, urging the lever 17, against the action of the spring 20, clockwise (viewing in FIG. 2) to disengage the valve 19 from the short pipe 12, thus opening the short pipe 12. Therefore, the air bleed passage 10 becomes operative in which additional air is bled into the fuel well 7 via the air bleed passage 10 to compensate for lack, in amount, of air bled into the fuel feed circuit 5 via the air bleed orifice 9.

Figure 8:
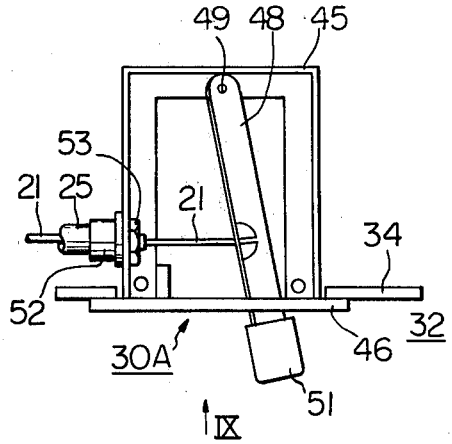
FIG. 8 shows a second embodiment of the present invention.
Figure 9:
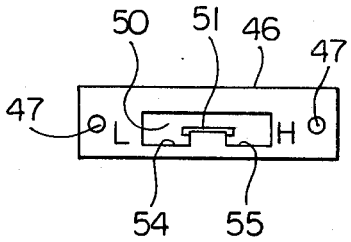
FIG. 9 is a plan view as viewed along an arrow IX in FIG. 8.

Another form of a control unit is shown in FIGS. 8 and 9. The control unit 30A shown herein comprises a casing 45 secured to a face plate 46 securely attached to an instrument panel 34 with a plurality of screws 47, and an arm 48 having one end rotatably mounted on the casing 45 at 49 and its other end projecting into a passenger compartment 32 through a window 50 formed in the face plate 46. A protective cover 51 is attached to the other end of the arm 48. A tube 25 jacketing a cable 21 is fixed to the casing 45 with a nipple 52 and a nut 53 for threaded engagement with the nipple. The cable 21 leads to the arm 48 and connected with the intermediate portion of the arm. The face plate 46 is formed with two grooves 54 and 55 spaced with each other along a direction in which the arm 48 is swingable (see FIG. 9), and has formed thereon markings "L" (abbreviation of "LOW") and "H" (abbreviation of "HIGH") which are positioned adjacent the grooves 54 and 55, respectively.

For operation of an automobile at low altitudes, the arm 48 is positioned in an "L" condition in which the arm engages in the groove 54, while for operation of the automobile at high altitudes, the arm 48 is positioned in an "H" condition as shown in FIG. 8 after anticlockwise (viewing in FIG. 8) rotation of the arm 48. In the "H" condition, the arm 48 engages in the other groove 55. This anticlockwise rotation of the arm 48 pulls the cable 21, urging a lever 17 clockwise (viewing in FIG. 2) to disengage a valve 19 from a short pipe 12 (see FIG. 2).

Figure 10:
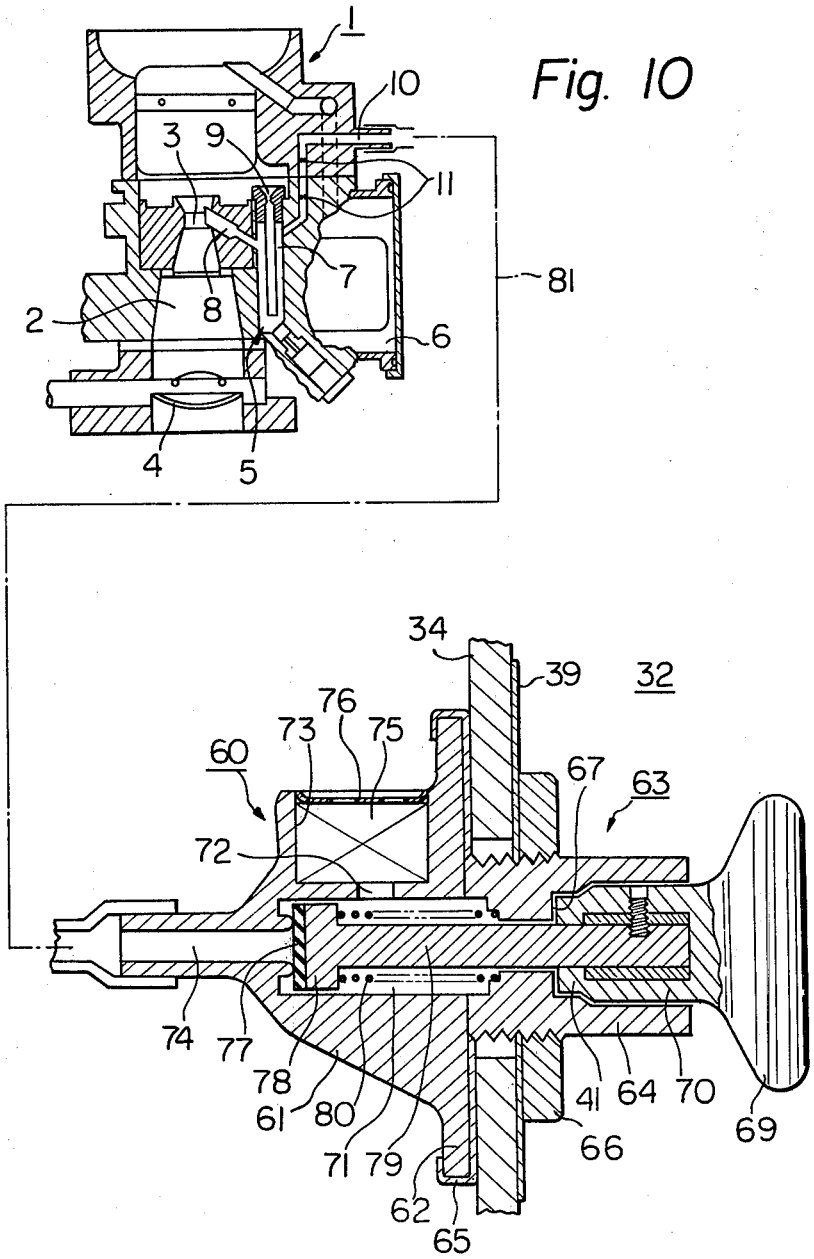
FIG. 10 shows a third embodiment of the present invention.
Figure 11:
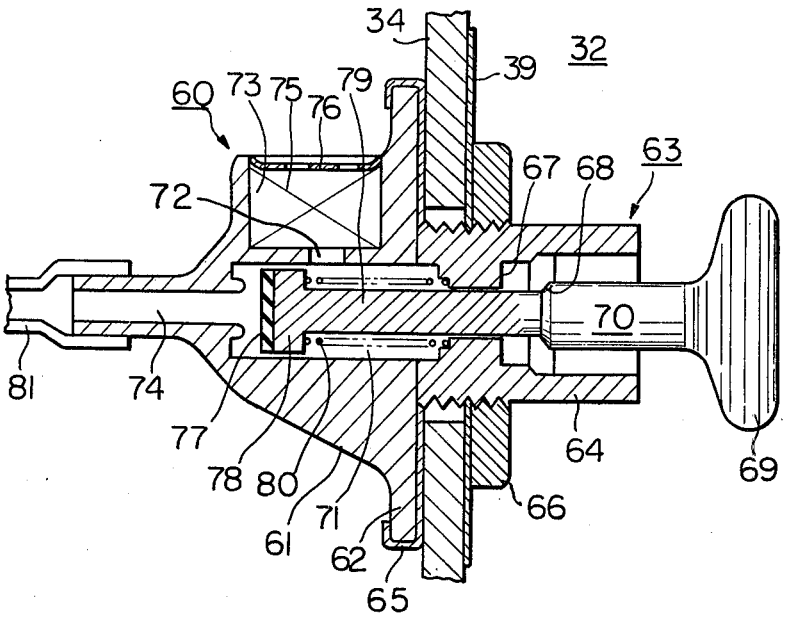
FIG. 11 is a fragmentary view showing a different condition of a device shown in FIG. 10.

Referring to FIGS. 10 and 11, this embodiment is different from the first embodiment shown in FIGS. 1–7 in that although, in the first embodiment, the air bleed control valve 16 is mounted within the air cleaner 14 and operatively connected with the manually operable knob 31 by means of the cable 21 for actuation by the knob 31. An air bleed control valve, in this embodiment, forms an integral unit with a control unit securely attached to a vehicle instrument panel and operatively connected with a manually operable knob of the control unit by means of a piston rod for actuation by the knob.

As shown in FIGS. 10 and 11, the air bleed control valve 60 has a housing 61 with a flange 62, while the control unit 63 has a member 64 which has a cylindrical section 65 receiving the flange 62. The edge of the cylindrical section 65 is crimped over the edge of the flange 62. The member 64 is securely attached to the instrument panel 34 with a nut 66, and formed with a deep straight groove 67 and a shallow groove 68 which crosses the deep straight groove 67 at right angles, in the similar manner to the first embodiment. The knob 69 has a tooth-like projection 70 similarly to the knob 31.

The housing 61 of the air bleed control valve 60 is provided with a cylindrical chamber 71, an inlet passage 72 communicating a filter chamber 73 with the cylindrical chamber 71, and an outlet passage 74 opening to the cylindrical chamber 71. The filter chamber 73 is filled with a suitable air filter 75 of a foaming urethane, and closed with an apertured retainer clip 76 for keeping the air filter 75 within the chamber 73.

A valve 77, which is adapted to close the outlet passage 74, is fixedly attached to a piston 78 at one end face thereof. The piston 78 has its piston rod 79 extending from the opposite end face thereof. The free end of the piston rod 79 extends into and is securely fixed to the knob 69.

The piston 78 is axially movable within the cylindrical chamber 71 and biased by a spring 80 toward a position illustrated in FIG. 10 in which the valve 77 closes the passage 74. The passage 74 is connected with an air bleed passage 10 of a carburetor by means of a tube 81.

For operation of an automobile at low altitudes, the knob 69 is in the illustrated position in FIG. 10 in which the tooth-like projection 70 engages in the deep groove 67 to allow the valve 77 to close the passage 74. In this position, the air bleed passage 10 is inoperative.

For operation of the automobile at high altitudes, the knob 69 is pulled, against the bias action of the spring 80, rightwardly (viewing in FIG. 10) and subsequently, turned through 90 degrees to a position shown in FIG. 11 in which the tooth-like projection 70 engages in the shallow groove 68 to urge the piston 78 rightwardly (viewing in FIG. 11) against the bias action of the spring 80 to open the passage 74. Atmosphere air is then bled into the carburetor 1, via the apertured clip 76, filter chamber 73, passage 72, cylindrical chamber 71, passage 74, tube 81 and air bleed passage 10 (see FIG. 10).

FIGS. 12–15 show the fourth embodiment in which a bell shaped housing 85, which is securely attached to a vehicle instrument panel 34 by means of a clamp 86 with a fastener 87, has a chamber 88 and a passage 89 opening to the chamber 88. The bell shaped housing 85 has its open end closed by a disc 90. The disc 90 has its outer edge portion clamped between the open end of the bell shaped housing 85 and an open end of a cup shaped cover 91, and is formed with a passage 92 extending therethrough. Denoted by 93 is an O-ring seal to seal between the open end of the housing 85 and the disc 90. An air filter 94 is kept within the chamber 88 to filter air flowing into a tube 81 connecting the passage with an air bleed passage 10 (see FIG. 10). Such air filter may be provided within the passage 89, if desired.

A valve 95, which is adapted to close the passage 92, is fixedly attached to a springy arm 96, of a springy metallic strip. The arm 96 has one end mounted to the disc 90 with a rivet 97 so that the arm 96 is swingable about the rivet 97, projects outwardly of the cover 91 through a window 98 formed through the peripheral wall of the cover 91, and has its free end covered with a cap 99. Denoted by 100 is a seal to seal around the rivet 97.

Figure 13:
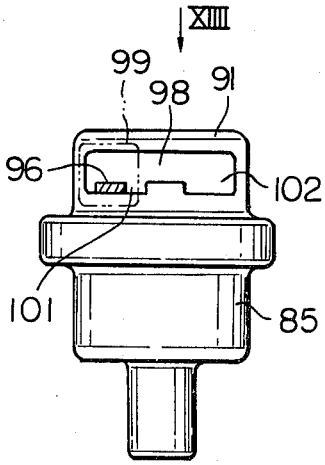
FIG. 13 is a plan view as viewed along an arrow XIII in FIG. 12.
Figure 14:
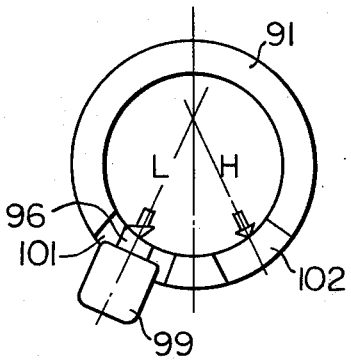
FIG. 14 is a plan view as viewed along an arrow XIV in FIG. 13.
Figure 15:
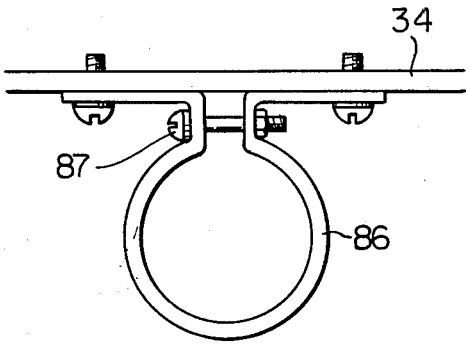
FIG. 15 is an end view showing a clamp to attach an apparatus to an instrument panel.

As shown in FIGS. 13 and 14, the cover 91 is formed with two grooves 101 and 102 which are spaced along a direction which the arm 96 is swingable. As best seen in FIG. 14, a marking "L" is formed on a face plate section of the cover 91 adjacent to the groove 101, while another marking "H" is provided adjacent to the groove 102.

Figure 12:
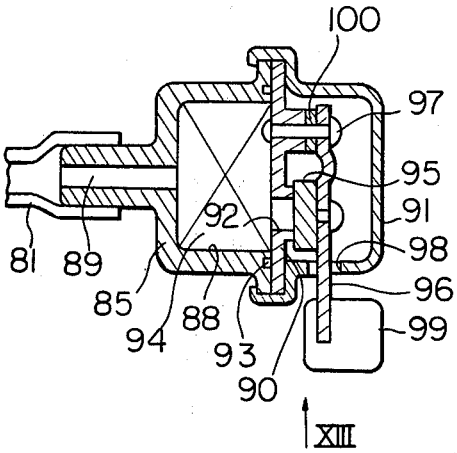
FIG. 12 is a sectional diagrammatic view showing a fourth embodiment of the present invention.

FIGS. 12 and 14 show an "L" condition in which the arm 96 engages in the groove 101 and biases the valve 95 toward the disc 90. In this condition, the valve 95 is in alignment with the passage 92 to close the same.

For operation of the automobile at high altitudes, the arm 96 is slightly lifted to disengage from the groove 101, swinged toward the groove 102, and then is engaged with the groove 102. The valve 95 is then disengaged from the disc 90 and displaced from the passage 92, opening the passage 92 to allow atmosphere air into the chamber 88.

Referring to the embodiment shown in FIGS. 16 through 20, a carburetor 110 used herein is different from the carburetor 1 used in the previous embodiment in that the carburetor 110 is a two barrel carburetor, while, the carburetor 1 is a single barrel carburetor.

Figure 16:
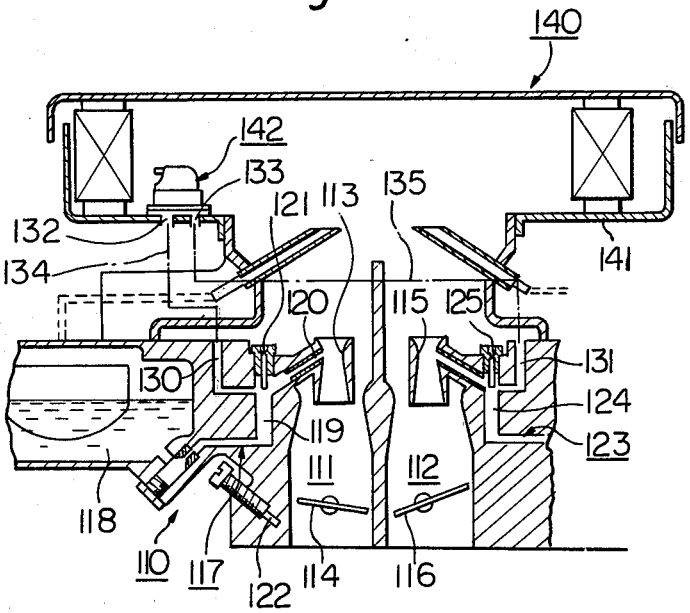
FIGS. 16, 17, and 18 show a fifth embodiment of the present invention.

Referring to FIG. 16, the carburetor 110 has an air induction passage 111 for the primary side and another air induction passage 112 for the secondary side. The air induction passage 111 is provided with a boost venturi 113 and a throttle valve 114, while, the another air induction passage 112 is provided with a boost venturi 115 and a throttle valve 116. A fuel feed circuit 117 for the primary side, which communicates a fuel float 118 with the boost venturi 113, comprises a fuel well 119 and a fuel nozzle 120 connecting the fuel well 119 to the boost venturi 113. Opening to the fuel well 119 is an air bleed orifice 121. A slow fuel feed circuit 122 is diagrammatically shown and is open to the air induction passage 111. Similarly to the primary side, a fuel feed circuit 123, which communicates the fuel float 118 with the boost venturi 115, comprises a fuel well 124. Opening to the fuel well 124 is air bleed orifice 125.

A first independent air bleed passage 130 is open to the fuel well 119 of the primary side and, a second independent air bleed passage 131 is open to the fuel well 124 of the secondary side, for the purpose of permitting an additional air to be bled into the fuel wells 119 and 124, when the altitude is high, to compensate the fuel feed circuits 117 and 123. Preferably, the slow fuel feed circuit 122 is compensated by providing a third air bleed passage, not shown, which leads from the first air bleed passage 130 to the slow fuel feed circuit 122.

The air bleed passages 130 and 131 are connected to two short pipes 132 and 133, respectively, with two respective rubber tubes 134 and 135. The two short pipes have their one ends projected into an air cleaner 140 for the carburetor 110 through a casing 141 of the cleaner. Mounted within the air cleaner 140 is an air bleed control valve 142 which opens or closes the two short pipes 132 and 133.

Figure 17:
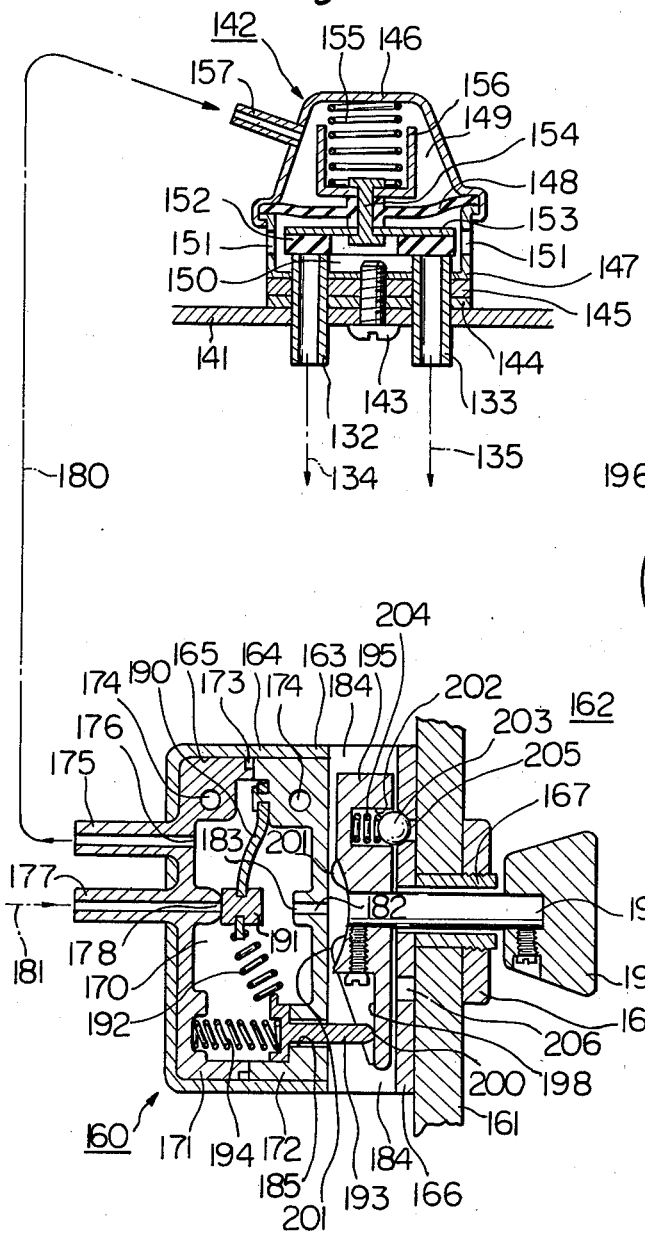

As best seen in FIG. 17, the air bleed control valve 142 has a housing secured to the bottom section of the casing 141 with a bolt 143 via a seal element 144 and a spacer 145. The housing has an upper section 146 and a lower section 147. A diaphragm 148 has its periphery securely clamped between the upper and lower housing sections 146 and 147 and divides the interior of the housing into an upper chamber 149 and a lower chamber 150 (viewing in FIG. 19). The lower housing section 147 has apertures 151 formed therethrough for communicating the lower chamber 150 with the ambient atmosphere. The two short pipes 132 and 133 (see FIG. 19 also) project into the lower chamber 150 by passing through the seal element 144 and the spacer 145. Cooperable with the adjacent ends of the two short pipes 132 and 133 is a valve 152, of a rubber like material, which is fixedly attached to a valve carrier 153. The valve carrier 153 is attached to the center portion of the diaphragm 148 with a rivet 154. Disposed within the upper chamber 149 is a compression spring 155 which biases the diaphragm 148 downwardly (viewing in FIG. 17) toward a position, illustrated in FIG. 17, in which the valve 152 engages the pipes 132 and 133 to close them. One end of the spring 155 seats on a spring retainer 156 attached to the diaphragm 148 with the rivet 154. The spring retainer 156 has a cylindrical wall section adapted to engage the wall of the chamber 149 to prevent further upward movement of the valve carrier 153 beyond a position illustrated in FIG. 19 in which the valve 152 disengages from the short pipes 132 and 133 to open them. The upper housing section 146 is formed with a nipple 157. The upper chamber 149 is selectively connectable with a source of vacuum, such as the engine manifold vacuum, or with the atmosphere, under the control of a control unit 160 securely mounted to an instrument panel 161 of a passenger compartment 162 of the vehicle.

The control unit 160 has a frame 163 having a cylindrical section 164 defining a blind bore 165, an end section 166 attached to the cylindrical section 165 to close the open end of the blind bore 165, and a hollow bolt section 167 projecting outwardly from the end section 166 into the passenger compartment 162. The control unit 160 is securely attached to the instrument panel 161 with a nut 168 threadedly engaging the hollow bolt section 167.

A pressure control chamber 170 is formed by two cup shaped casings 171 and 172 which are received in the blind bore 165 with their end faces contacting with each other with an annular seal 173 interposed between the end faces of the cup shaped casings. Forward and rearward cup shaped casings 171 and 172 are fixed to the cylindrical section 164 of the frame 163 with a plurality of bolts, only their bolt holes being shown at 174. The forward casing 171 which is adjacent to the bottom wall of the blind bore 165, has a nipple 175 defining an outlet port 176 of the chamber 190 and a second nipple 177 defining an inlet port 178 of the chamber 170.

The nipple 175 is connected with the nipple 157 with a rubber tube 180 to establish a fluid connection between the upper chamber 149 and the pressure control chamber 170. The nipple 177 is connected with the engine manifold, not shown, with a rubber tube 181.

The rearward casing 172 has an axial passage 182. The passage 182 has one end opening to the chamber 170 at a port 183 positioned opposite to the port 178, and its other end communicating with the atmosphere via apertures 184 formed through the frame 163. The rearward casing 172 is formed with a bore 185 extending therethrough.

A plate spring 190, having one end fixed to the rearward casing 172, carries at its free end a valve 191 cooperable both with the nipple 177 and the passage 182. A coil spring 192 has one end anchored to the free end of the plate spring 190 and its other end attached to a cam follower 193.

The cam follower 193 slidably extends through the bore 185 and is biased by a spring 194 to cooperate with a disc cam 195 rotatably disposed within the frame 163 between the rearward casing 172 and the end section 166. The disc cam 195 is rotatable by a manually operable knob 196 via a rod 197 which is rotatable within the hollow bolt section 167. The disc cam 195 is formed at its side adjacent to the rearward casing 172 with a cam surface 198 with which a tip 200 of the cam follower 195 slidably engages.

In order to provide a clearance between the rearward casing 172 and the disc cam 195, a plurality of projections 201 are formed at radially inward portion of the cam surface 198. With this clearance a fluid communication between the passage 182 and the apertures 184 is secured.

The disc cam 195 is formed with a blind bore 202 which receives a detent ball 203 and biased outwardly of the blind bore 202 by a detent spring 204. The detent ball 203 is engageable with two circumferentially spaced detent recesses 205 and 206 formed in the end section 166.

Figure 18:
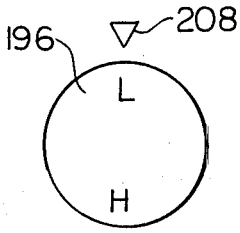
Figure 19:
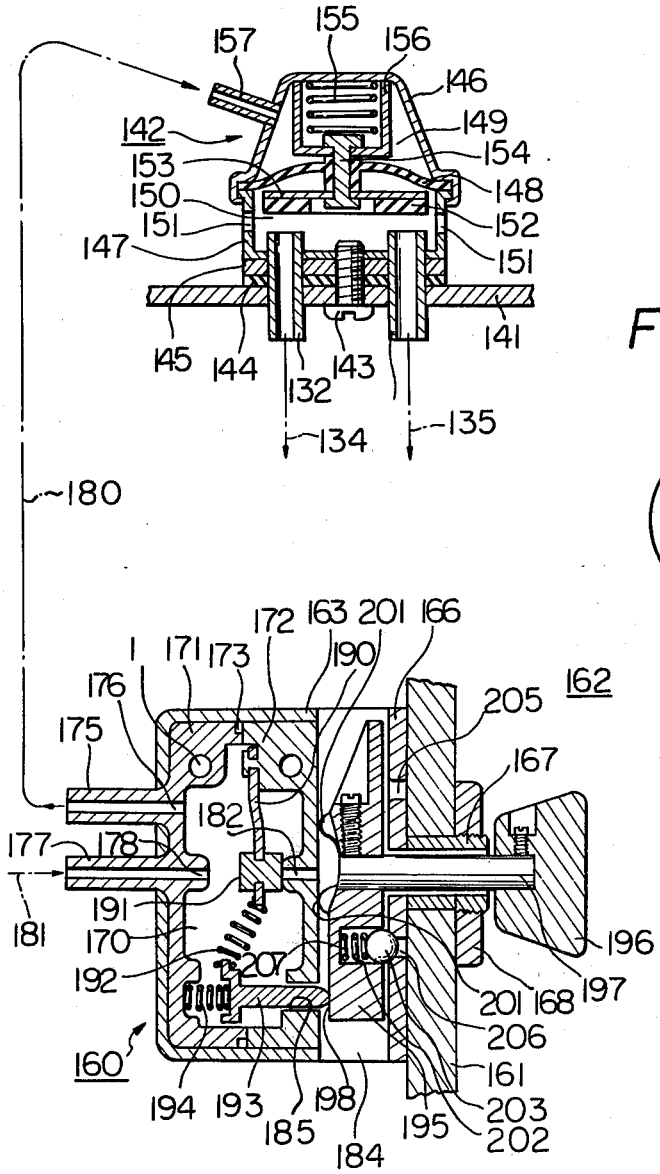
FIGS. 19 and 20 are views showing a different, high-altitude condition of the device shown in FIG. 17.

The manually operable knob 197 has formed thereon markings "L" and "H", while the instrument panel 161 has a marking 208 as shown in FIG. 18.

The operation of this embodiment is as follows:

For use of an automobile at low altitudes, the manually operable knob 196 is at a position shown in FIGS. 17 and 18. Then the detent ball 203 engages in the recess 205 to define this position. Under this condition, the cam follower 193 engages a relatively low portion of the cam surface 198 and thus is in the illustrated position shown in FIG. 17 under the action of the spring 194, causing the spring 192 to urge the plate spring 190 leftwardly (viewing in FIG. 17) toward the illustrated position to cause the valve 191 to close the nipple 177. This allows atmospheric air into the upper chamber 149 via the apertures 184, the clearance between the rearward casing 172 and the disc cam 195, the passage 182, the chamber 170, the nipple 175, the tube 180, and the nipple 157, to maintain the pressure within the upper chamber 149 at the atmospheric level, allowing the spring 155 to urge the valve carrier 153 to the illustrated position (shown in FIG. 17) to cause the valve 152 to close the pipes 132 and 133. Hence, the entry of atmosphere air into the first and second air bleed passages 130 and 131 (see FIG. 16) is prevented, and fuel within the fuel feed circuits 117 and 123 mixes with air bled through the air bleed orifices 121 and 125 only.

Figure 20:
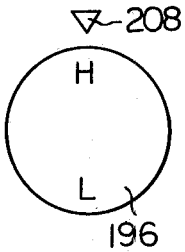

For use of the automobile at high altitudes, the manually operable knob 196 is rotated through 180 degrees to the illustrated position in FIG. 20. This rotation of the knob 196 will cause the disc cam 195 to rotate toward the position illustrated in FIG. 19, in which the detent ball 203 engages in the recess 206. The rotation of the disc cam 195 will urge the cam follower 193, against the action of the spring 194, leftwardly toward the illustrated position (viewing in FIG. 19). Under this condition, the cam follower 193 engages a relatively high portion of the cam surface 234, and causes the spring 192 to urge the plate spring 190 rightwardly toward the illustrated position (viewing in FIG. 19) to cause the valve 191 to close the passage 182. This allows the manifold vacuum to be transmitted to the upper chamber 149, via the tube 181, the nipple 177, the chamber 170, the nipple 175, the tube 180, and the nipple 157. Then, atmospheric pressure within the lower chamber 150 urges the diaphragm 148 upwardly (viewing in FIG. 19) against the action of the spring 155, causing the valve member 152 to open the short pipes 132 and 133. Hence, additional air, for altitude compensation, is bled into the fuel feed circuits 117 and 123, and fuel within these fuel feed circuits mixes not only with air bled through the air bleeds 121 and 125, but also with the additional air bled through the short pipes 132 and 133.

It will now be understood that an arrangement in which an air bleed control valve mounted within an air cleaner is operable with a manually operable knob or lever in a passenger compartment has made it quite easy for a driver to adjust a carburetor to a condition suitable for use at high altitudes.

It will also be understood that an altitude compensation system according to the present invention does not employ an aneroid bellows for long life and therefore is highly resistant to vehicle vibrations.

It is to be noted in connection with the last embodiment that the use of vacuum, instead of mechanical linkage, to transmit a demand of an operator to an air bleed control valve has made it unnecessary to adjust the mechanical linkage.

Although in the preceding embodiment, the effect of altitude on main fuel feed circuit is made by a valve to open and close an additional air bleed passage opening to the circuit, the effect of altitude on slow fuel feed circuit may be made only by providing an additional air bleed circuit opening to the slow fuel feed circuit in such a manner as to be opened and closed by the same valve. By doing so more precise altitude compensation over the various operating conditions of an automobile is possible.

What is claimed is:

1. An automobile provided with a fuel feed means having at least one air induction passage leading from an air cleaner and at least one fuel feed circuit means for supplying fuel into the air induction passage, the fuel feed circuit having an air bleed means, the fuel feed means comprising at least one additional air supply passage leading to the fuel feed circuit means and an air bleed control valve for closing the additional air supply passage, in which said air bleed control valve is actuated to open said additional air supply passage by a control unit having a manually operable part; and in which said manually operable part is disposed in a passenger compartment of the automobile and in which said air bleed control valve is a vacuum actuated valve disposed in said air cleaner, and in which said control unit applies atmospheric pressure to said air bleed control valve when said manually operable part is in a first position and it applies a vacuum to said air bleed control valve when said manually operable part is in a second position.

2. An automobile as claimed in claim 1, in which said air bleed control valve comprises a valve cooperable with said additional air supply passage, spring means for urging said valve toward a valve closed position in which said air bleed control valve closes said additional air supply passage, and diaphragm means for urging said valve, against the action of said spring means toward a valve open position, in which said air bleed control valve opens said additional air supply passage, when the vacuum is applied to said air bleed control valve.

3. An automobile as claimed in claim 1, in which said control unit comprises a chamber, a first passage means for connecting said chamber to said air bleed control valve, a second passage means for connecting said chamber to a source of vacuum, and a third passage means for connecting said chamber to the ambient atmosphere; and in which said control unit comprises a valve means for selectively closing said second and third passage means in response to selection of said manually operable part between the first position and the second position.

4. An automobile as claimed in claim 3, in which said valve of said control unit is fixedly carried at the free end of a plate spring whose other end is fixed and urged toward said second passage means, in which said control unit comprises a disc cam rotatable by said manually operable part and cam follower means cooperating with said disc cam and with said free end of said plate spring for urging said valve of said control unit toward said third passage means when said manually operable part is in the second position.

5. In an automobile having an internal combustion engine, a carburetor having a fuel feed circuit including a fuel well and an air bleed passage opening to said fuel well and an air cleaner mounted on said carburetor and an additional air bleed passage fluidly interconnecting said air cleaner and said fuel well of said fuel feed circuit, a valve disposed in said air cleaner, said valve having a first position in which filtered air is permitted to pass through said additional air bleed passage to said fuel well and a second position in which said filtered air is prevented from passing through said additional air bleed passage, means disposed in the passenger compartment of said automobile and which is operatively connected to said valve for selectively moving said valve between said first and second positions thereof, said valve being actuated by a vacuum motor having a vacuum chamber which when supplied with a source of vacuum moves said valve into said first position and which when supplied with atmospheric pressure moves said valve into said second position thereof; said means being a cam operated two position snap action switch which connects a source of vacuum to said vacuum chamber in a first position thereof and which supplies atmospheric pressure to said vacuum chamber in the second position thereof.

* * * * *